US005971453A

United States Patent [19]

Schlisner

[11] Patent Number: 5,971,453

[45] Date of Patent: Oct. 26, 1999

[54] DEVICE FOR INSTALLING WALL BASE

[75] Inventor: Dennis G. Schlisner, Benton City, Wash.

[73] Assignee: Bind-N-Stix Twin Track LLC, Kennewick, Wash.

[21] Appl. No.: 09/221,371

[22] Filed: Dec. 28, 1998

[51] Int. Cl.[6] ..... A47G 27/04; B30B 3/00

[52] U.S. Cl. ..... 294/8.6; 29/270; 156/579

[58] Field of Search ..... 294/8.6, 1.1; 81/488; 7/103; 156/71, 579, 582, DIG. 39; 29/270, 238, 243.5

[56] References Cited

U.S. PATENT DOCUMENTS

| | | | |
|---|---|---|---|
| 2,533,209 | 12/1950 | Ames | 156/579 |
| 3,617,082 | 11/1971 | Sparks | 294/8.6 |
| 3,830,118 | 8/1974 | Holub, III et al. | 81/3 R |
| 4,224,726 | 9/1980 | Walker | 29/121.1 |
| 4,439,904 | 4/1984 | Hoopengardner et al. | 29/110.5 |
| 4,569,261 | 2/1986 | Morris | 81/488 |
| 4,605,253 | 8/1986 | Anderson | 294/8.6 |
| 4,613,396 | 9/1986 | Scarborough | 156/391 |
| 4,614,349 | 9/1986 | Wenzel | 280/43.1 |
| 4,861,400 | 8/1989 | Sargent | 156/579 |
| 4,949,604 | 8/1990 | Squires | 81/488 |
| 5,045,146 | 9/1991 | Rundo | 156/579 |
| 5,316,614 | 5/1994 | Phillips | 156/574 |
| 5,478,433 | 12/1995 | Magalhaes | 156/579 |
| 5,516,170 | 5/1996 | Kruskamp | 294/8.6 |

*Primary Examiner*—Dean J. Kramer
*Attorney, Agent, or Firm*—Luedeka Neely & Graham PC

[57] ABSTRACT

A device for installing wall base, such as carpet base, the device including a body member having a handle extending upwardly from the upper surface of the body member and graspable by a user to apply pressure to the body member during use of the device to install the wall base; and a pair of roller units mounted to the body member, wherein one roller unit is positionable to be urged against the flooring surface and the other roller unit is positionable to be urged against the wall base while the device is moved in a direction generally parallel to the length of the wall base to enable the user to apply pressure to the wall base to urge it against the wall.

9 Claims, 6 Drawing Sheets

DEVICE FOR INSTALLING WALL BASE

FIELD OF THE INVENTION

This invention relates generally to devices for installing carpet and other flexible flooring. More particularly, this invention relates to devices for installing wall bases along the base of a wall to protect the lowermost part of the wall adjacent the wall-floor intersection.

BACKGROUND AND SUMMARY OF THE INVENTION

Flooring wall bases are commonly provided by lengths of relatively rigid materials (e.g. wood or hard plastic) or flexible materials (e.g. flexible plastic, rubber, or strips of carpet) having widths of from about 3 to about 6 inches, most typically from about 3½ to about 5 inches. Such flooring bases are typically attached along the lowermost portions of a vertical wall adjacent the wall-floor intersection using fasteners such as nails or staples or an adhesive applied between the base material and the wall.

As will be appreciated, when using adhesive to attach the base to a wall it is important to firmly press the base against the wall during installation. This is often difficult and awkward given the position of the base relative to the wall and floor.

Accordingly it is an object of the present invention to provide an improved device for installing a wall base.

A further object of the present invention is to provide a device of the character described which facilitates installation of a wall base using adhesive to vertical wall surfaces.

Still another object of the present invention is to provide a device of the character described which is uncomplicated in construction and is economical and convenient to use.

With regard to the foregoing and other objects, the present invention is directed to a device for installing an elongate wall base on a wall extending at an angle from a flooring surface. In a preferred embodiment, the device includes a body member having a handle extending upwardly from the upper surface of the body member and graspable by a user to apply pressure to the body member during use of the device to install the wall base; and a pair of roller units mounted to the body member, wherein one roller unit is positionable to be urged against the flooring surface and the other roller unit is positionable to be urged against the wall base while the device is moved in a direction generally along the length of the wall base to enable the user to apply pressure to the wall base to urge it against the wall.

In another aspect, the invention provides a wall base installation device having a body member and a pair of roller units mounted to the body member. The body member has a thickness and oppositely facing upper and lower surfaces spaced apart by the thickness of the body member. The body member also preferably includes a first pair of spaced-apart supports extending outwardly from a first portion of the thickness of the body member to define a first recess bounded by mutually facing surfaces of the first pair of supports and the first portion of the thickness of the body member, and a second pair of spaced-apart supports extending outwardly from a second portion of the thickness of the body member to define a second recess bounded by mutually facing surfaces of the second pair of supports and the second portion of the thickness of the body member.

A handle extends upwardly from the upper surface of the body member and graspable by a user to apply pressure to the body member during use of the device to install the wall base.

The first roller unit is positioned within the first recess and has a first axle extending between the first pair of supports. The first roller unit preferably includes a plurality of independently rotatable roller members positioned adjacent to one another and substantially aligned in a parallel spaced-apart relationship to one another along the first axle of the first roller unit, the roller members of the first roller unit each being rotatable around the first axle of the first roller unit.

The second roller unit is positioned within the second recess and has a second axle extending between the second pair of supports. The second roller unit includes a plurality of independently rotatable roller members positioned adjacent to one another and substantially aligned in a parallel spaced-apart relationship to one another along the second axis of the second roller unit, the roller members of the second roller unit each being rotatable around the second axle of the second roller unit.

The first roller unit is positionable to urge substantially all of the first roller members against the flooring surface and the second roller unit is positionable to urge substantially all of the second roller members against the wall base, while the device is moved in a direction generally along the length of the wall base to enable the user to apply pressure to the wall base to urge it against the wall.

It is particularly preferred that the first axle and the second axle be disposed at an angle relative to one another which substantially corresponds to the angle between the wall to which the base is applied and the flooring surface intersecting the wall.

The device of the invention is particularly suitable for installing wall bases of the type secured to a wall as by adhesive. As will be appreciated, it is important during the installation of such bases to uniformly press the base against the wall to facilitate adhesive attachment of the base to the wall.

An important aspect of the invention relates to the provision of roller units which are angled relative to one another corresponding to the angle between the flooring surface and the wall to which the base is applied, which is typically about 90°. This is advantageous to maintain substantially uniform pressure against the wall base while also minimizing installation time for installing the wall base.

BRIEF DESCRIPTION OF THE DRAWINGS

The above and other features and advantages of the present invention will become further known from the following detailed description considered in conjunction with the accompanying drawings in which.

DETAILED DESCRIPTION

Figure 1:
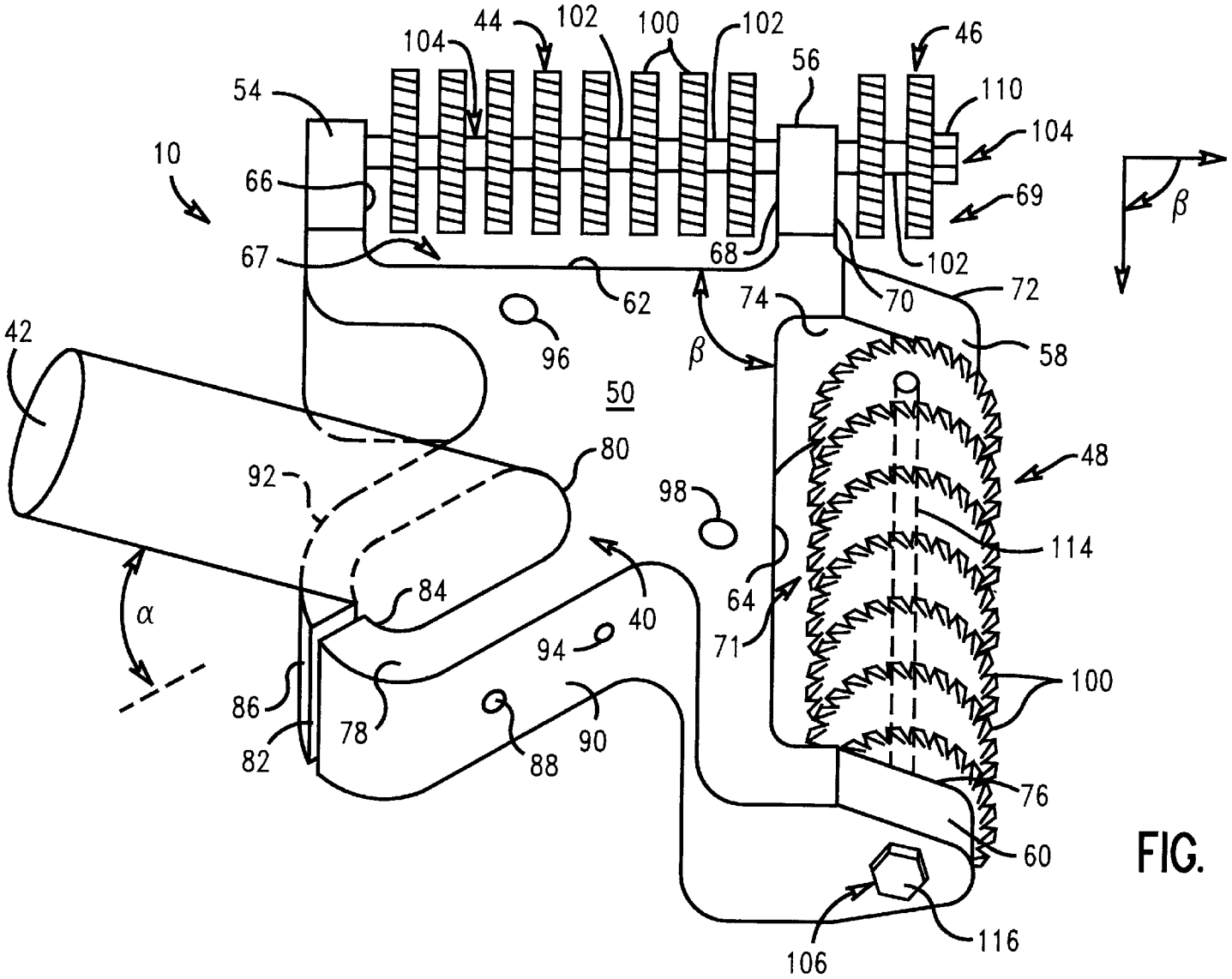
FIG. 1 is a perspective view showing a wall base installation device according to the invention.
Figure 2:
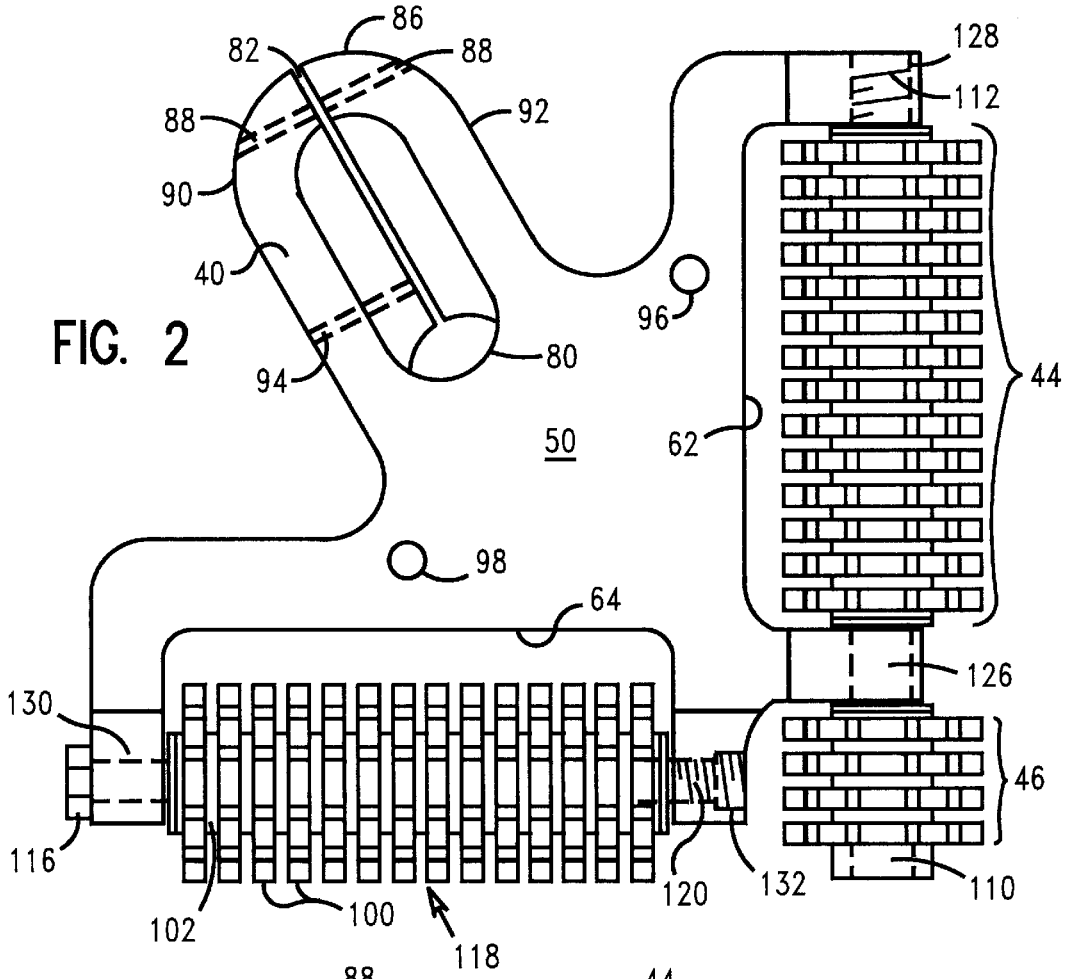
FIG. 2 is an elevational view of the device of FIG. 1.
Figure 3:
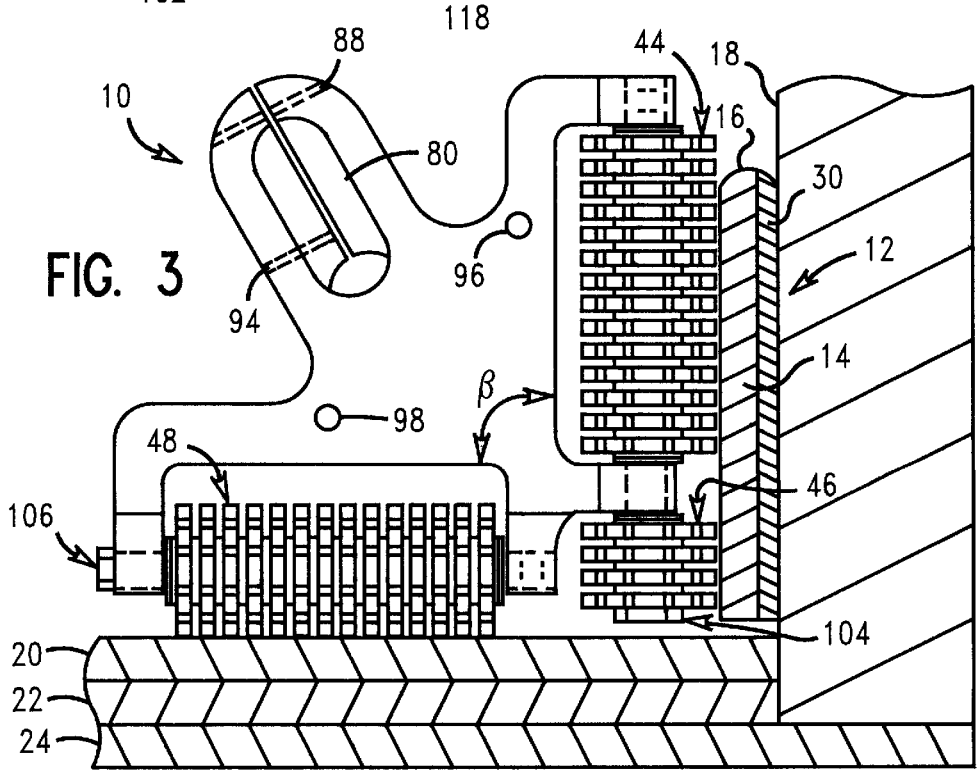
FIG. 3 is an elevational view showing use of the device of FIG. 1 for installing a wall base.

With initial reference to FIGS. 1–3, there is shown a device 10 in accordance with one embodiment of the invention for installing a wall base such as a wall base 12 made of a carpet material to be adhered to a wall surface, preferably by use of an adhesive (FIG. 3). A preferred base 12 for use with the installation device 10 of the invention is a wall base available under the trademark BIND-N-STIX from Advanced Flooring Supplies, Inc. of Kennewick, Wash. and described in U.S. patent application Ser. No. 08/846,797, filed Apr. 30, 1997, entitled WALL BASE, incorporated herein by reference in its entirety.

The preferred wall base 12 is provided by an elongate strip of carpeting material 14 having a width of from about 3 to about 6 inches and a length corresponding to the wall on which the base is to be installed. The thickness of the material 14 typically ranges from about ¼ to about ¾ inch. The upper edge of the carpet material 14 is preferably finished with a binding material 16 in a manner well known in the art to provide an aesthetically pleasing appearance to the base (to cover a cut edge) and to avoid unraveling or fraying of the cut edge.

As shown in FIG. 3, the base 12 is preferably installed along the lowermost portion of a vertical wall 18 adjacent the edges of horizontally disposed wall-to-wall carpeting 20 to provide a decorative appearance. Conventionally, the carpet 20 overlies a carpet pad 22 which overlies a subflooring 24. The backside surface of the base 12 which is to be positioned adjacent wall 18 includes a pair of spaced-apart, parallel adhesive strips 30 and 32 which adhere the base 12 to the wall 18. It will be understood, however, that the present invention is suitable for installing wall bases attached to the wall in other manners including, but not limited to fasteners and adhesives of the type applied as a liquid to the wall base and/or the wall. In this regard, the term "installing" will be understood to refer to the act of pressing the wall base against the wall so that it lies substantially flat on a flat wall and otherwise conforms to the topography of the wall or surface onto which it is attached.

Returning to FIG. 1, the device 10 preferably includes as major components a main body member 40 having a handle 42 attached thereto and rotatably supporting roller units 44, 46 and 48. The handle 42 is preferably of adjustable length and extends upwardly and away from the body member 40 as described in more detail below.

As a brief example of a preferred manner of use of the device 10, it will be understood that the handle 42 may be grasped by a user and the body member 40 positioned as shown in FIG. 3 with the roller unit 48 bearing against the carpet 20 and the roller units 44 and 46 bearing against the base 12 to urge the base 12 against the wall 18 as the device 10 is moved in a generally linear direction along the length of the wall base 12.

Figure 4:
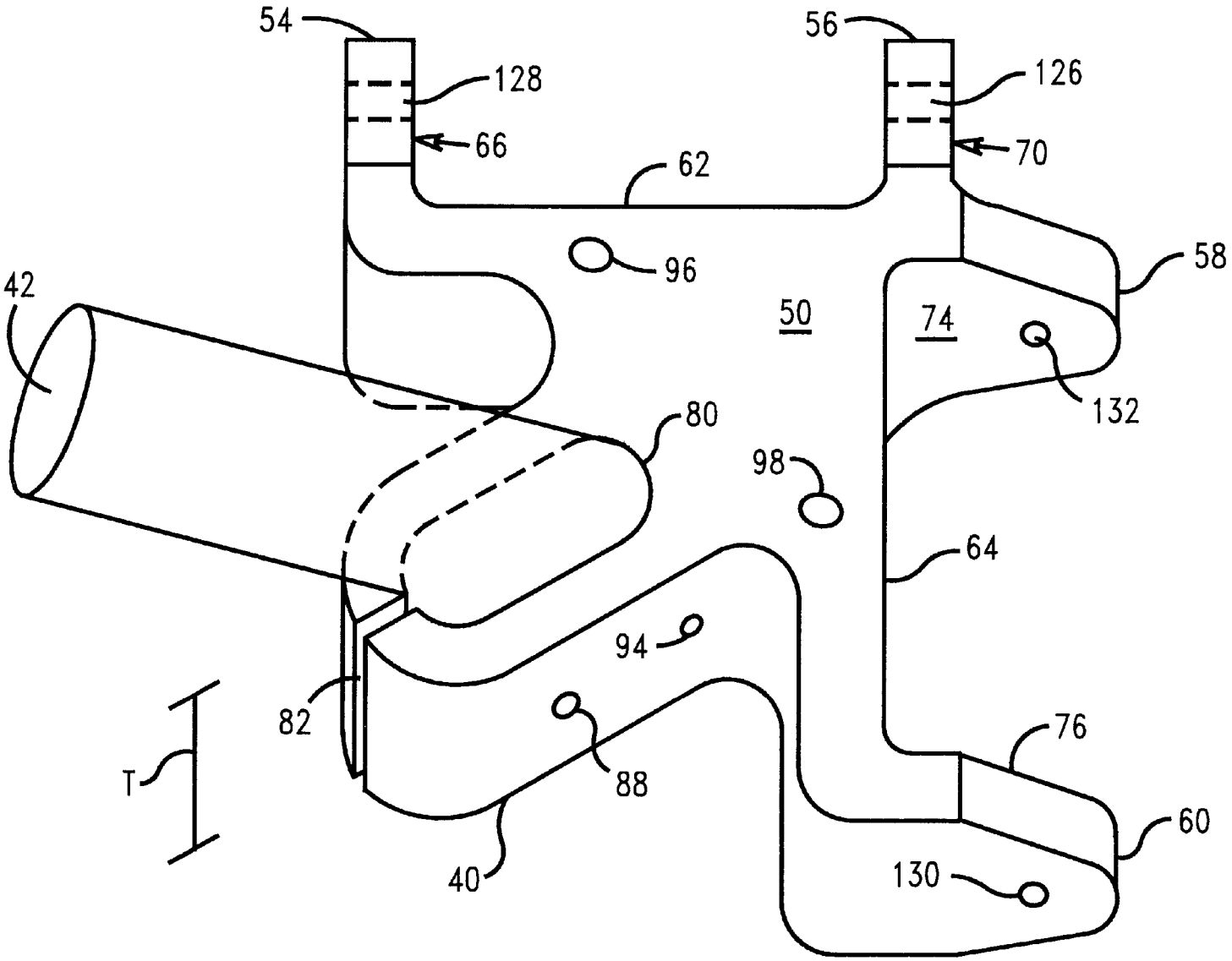
FIG. 4 is a perspective view of a component of the device of FIG. 1.
Figure 6:
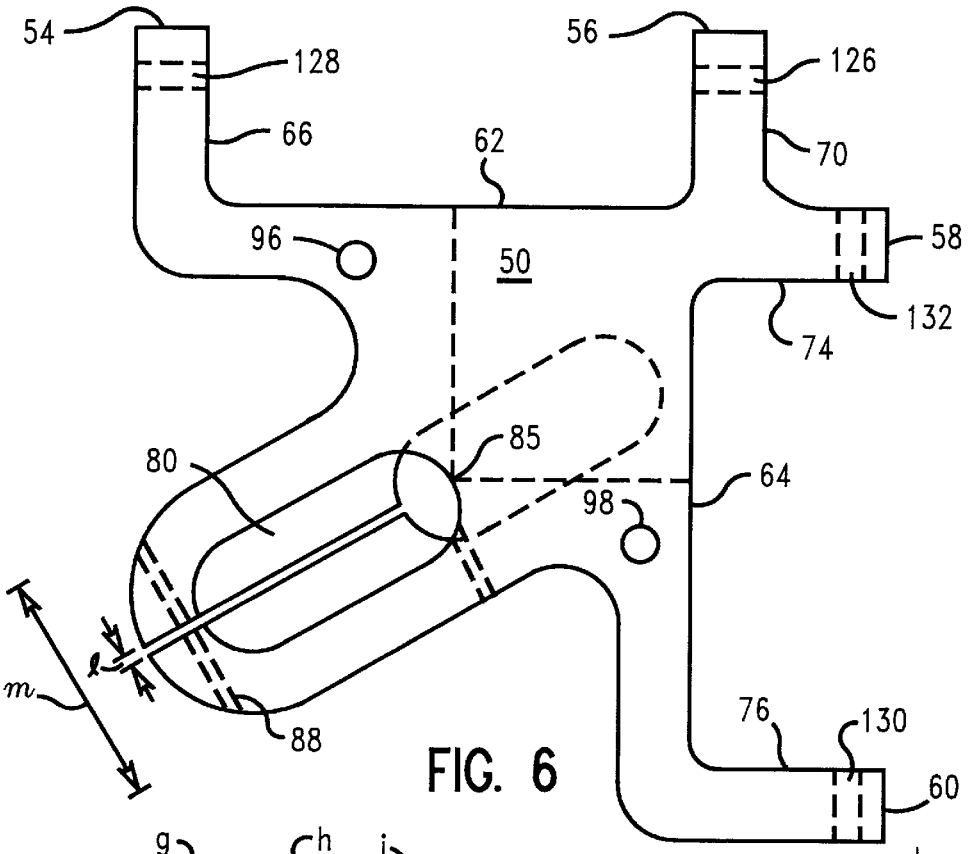
FIG. 6 is a top plan view of the component of FIG. 4.
Figure 5:
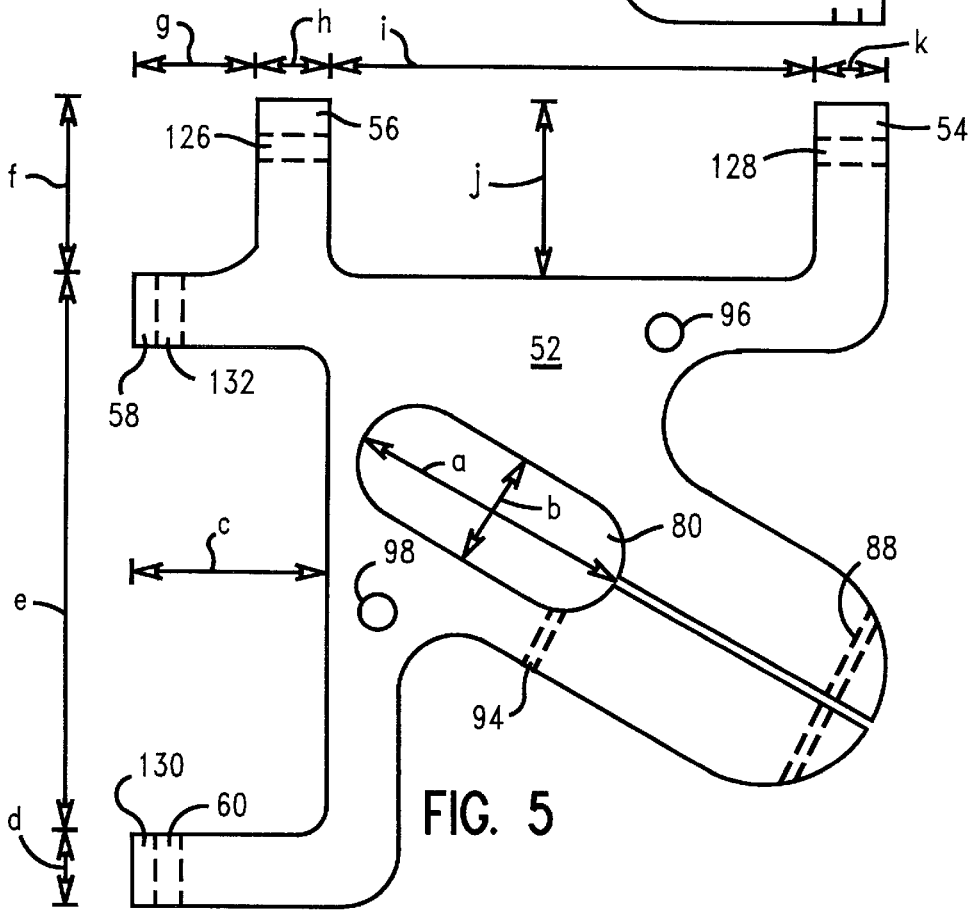
FIG. 5 is a bottom plan view of the component of FIG. 4.

With additional reference to FIGS. 4–6, the body member 40 is preferably of one-piece construction and made of a strong, rigid material such as aluminum, steel, iron and the like and is preferably machined from a block of aluminum. The member 40 includes a substantially flat and smooth upper surface 50 opposite a lower surface 52, with a preferably uniform thickness T separating the surfaces 50 and 52 of preferably from about ½ inch to about 1½ inches, and most preferably about 1 inch.

The body member 40 preferably includes roller supports 54 and 56 which support roller units 44 and 46, and roller supports 58 and 60 which support roller unit 48. The roller units 44 and 46 are preferably aligned with one another along a first axis and disposed at an angle β relative to a second axis of the roller unit 48. When the device 10 is used as described herein, that is to install carpet base onto a wall extending generally vertically from a perpendicular floor surface, it is preferred that the angle β is about 90°. However, it will be understood that the angle β may be other than 90° and preferably corresponds to the angle between the wall to which the base is applied and the underlying floor.

The supports 54 and 56 are spaced apart and a sidewall 62 of the body member extends between the supports 54 and 56. Likewise, a sidewall 64 extends between the supports 58 and 60. Inner surface 66 of the support 54 and inner surface 68 of the support 56 are adjacent to and generally perpendicular to the sidewall 62 for defining a generally U-shaped recess 67 into which the roller unit 44 may be received.

A generally L-shaped structure 69 is defined between outer surface 70 of the support 56 and outer surface 72 of the support 58 for receiving the roller unit 46. Inner surface 74 of the support 58 and inner surface 76 of the support 60 are adjacent to and generally perpendicular to the sidewall 64 and define a generally U-shaped recess 71 into which the roller unit 48 may be received. In this regard, sidewalls 62 and 64 are preferably oriented such that they are substantially perpendicular to one another and rise at right angles from the generally flat lower surface 52. However, it will be understood that they may be oriented at other angular relations relative to one another depending on the wall surface to which the base is to be applied. For example, if the surfaces 52 and 50 were desired to be of different configuration, the sidewalls 62 and 64 could extend at an angle other than a 90° angle from one to the other and could be angled at an angle of other than 90° relative to one another.

A handle-receiving portion 78 of the body member 40 is provided to supportably receive the handle 42 and to orient the handle to facilitate use of the device 10. In this regard, the portion 78 is preferably integral with the body member and includes a generally oblong, cylindrical cut-out 80 which opens to both the surfaces 50 and 52 and extends through the body member such that the handle is preferably oriented at an angle α of from about 30° to about 40° most preferably about 35° when the handle is installed.

The lower end of the handle is likewise cut at the angle α, preferably such that it does not extend past the lower surface 52 so that the bottom of the device is substantially flat and smooth. To facilitate insertion and retention of the handle 42 within the cut-out 80, an elongate slit 82 preferably extends the thickness of the portion 78 from backmost edge 84 of the cut-out 80 to outwardly facing, curved sidewall 86 of the portion 78. A front midpoint 85 of the cut-out is preferably about 1⅜ inches from each sidewall 62 and 64 as indicated by the dashed lines shown in FIG. 6, with the length axis of the cut-out lying at an angle δ of from about 60° to about 70° degrees, most preferably about 65° degrees relative to the length axis of the sidewall 64.

As will be appreciated, the slit 82 enables expansion and contraction of the cut-out. For example, the slit 82 enables expansion of the cut-out 80 to accommodate the handle as it is inserted therein. Mechanical closure of the slit 82 and hence contraction of the cut-out 80 may be accomplished as by inserting a threaded bolt into aperture 88, one end of which opens to sidewall 90 of the portion 78 and the other end of which opens to an opposite sidewall 92, with the terminal end of the aperture 88 adjacent the sidewall 92 being threaded to threadably receive a bolt or other fastener. An aperture 94 also preferably opens to sidewall 90 and extends into the cut-out 80. A corresponding threaded opening may be provided on the handle portion adjacent the aperture 94 for receiving a bolt or other fastener to further anchor the handle within the cut-out 80. Cylindrical apertures 96 and 98 preferably extend through the thickness of the body member 40 from the surface 50 to the surface 52. The apertures 96 and 98 receive corresponding rods of a jig during assembly of the roller units to hold the body member against movement.

The roller units 44, 46 and 48 are each preferably provided as by a plurality of roller members 100, preferably of metal such as steel, rotatably mounted on a first axle, with each roller member 100 preferably being spaced apart from its adjacent members 100 by spacers such as washers 102 also mounted on the first axle. In this regard, roller unit 44 and roller unit 46 preferably share a common axle 104 and roller unit 48 is mounted on a second axle 106.

In a preferred embodiment, each axle 104 and 106 is preferably provided by a metal bolt, with the bolt providing the first axle 104 having a shaft 108, with head 110 provided at one end of the shaft 108 and threads 112 provided on the other end thereof. Likewise, the bolt providing the second axle 106 includes a shaft 114, with head 116 provided at one end of the shaft 118 and threads 120 provided on the other end thereof. The bolts providing the axles 104 and 106 preferably have a diameter of about 3/16 inch, with the bolt providing the first axle 104 having a length of about 4½ inches and the bolt providing the second axle 106 having a length of about 3½ inches. As will be appreciated, the device may be provided in various dimensions, with the foregoing dimensions being preferable when the device is constructed according to the dimensions set forth hereinafter in Table 1.

Figure 7:
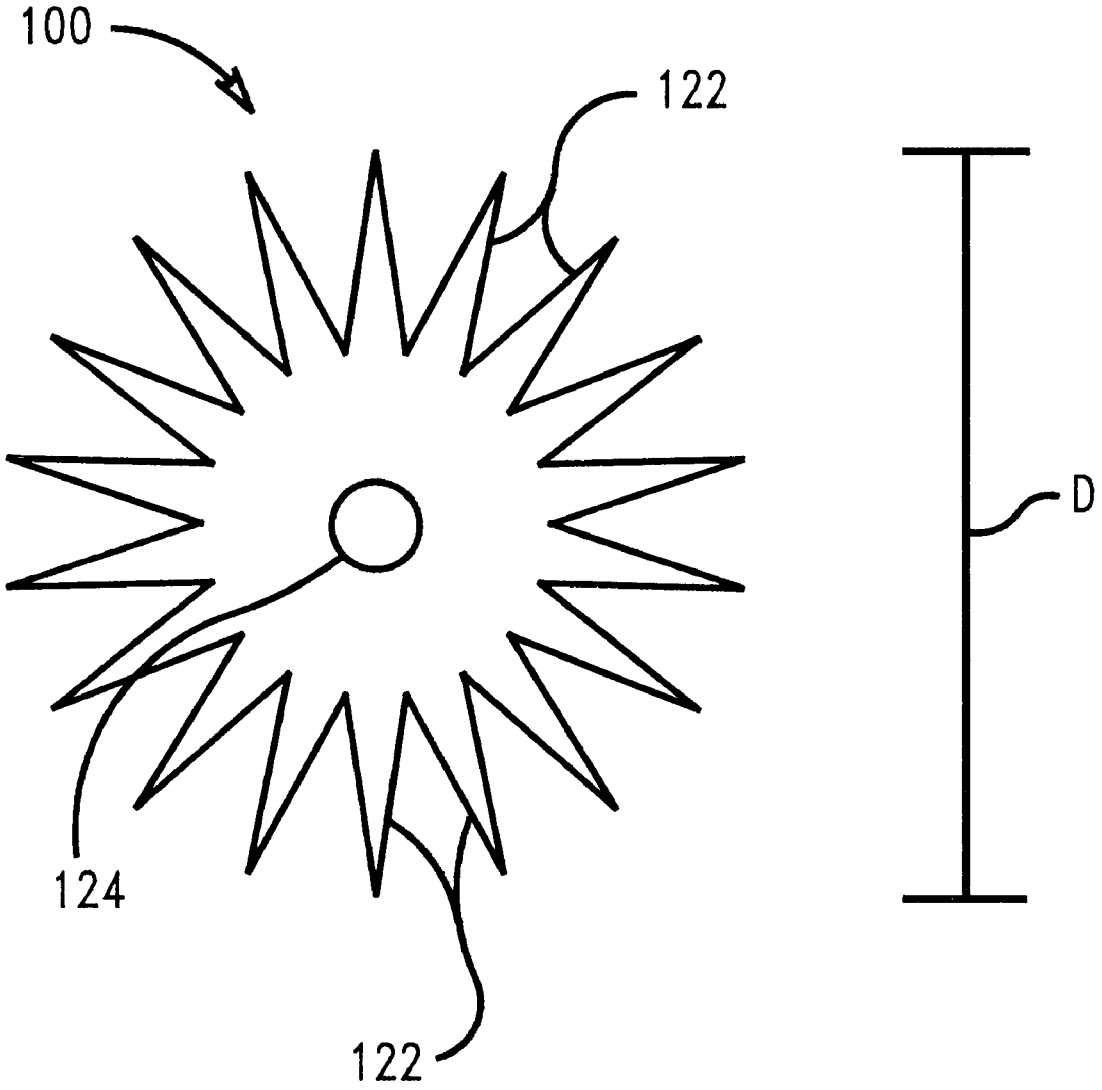
FIG. 7 is a side view of a preferred roller member for use in the device of FIG. 1.

The roller units 44 and 48 each preferably include about 13 roller members 100 and the roller unit 46 preferably includes about 4 roller members 100. The roller members 100 may be of various configuration, but are preferably provided by disks having the general spur shape shown in FIG. 7 and having a plurality of points or spikes 122, preferably from about 12 to about 24, and most preferably about 18 points extending radially therefrom. An aperture 124 is preferably provided through the thickness of each member 100 for receiving the shaft of the axle or bolt on which it is mounted. The member 100 preferably has a thickness of from about 0.090 to about 0.095 inch, preferably about 3/32 inch and a tip-to-tip diameter D of from about 1.220 to about 1.250, preferably about 1¼ inches.

The roller units 44 and 46 may be installed on the member 40 as by threading the roller members 100 and washers 102 onto the shaft 108 of the axle or bolt 104 and passing the treaded end 112 of the shaft 108 through a smooth aperture 126 provided through the thickness of the support 56 toward the support 54. The roller members 100 and washers 102 associated with the roller unit 44 are then positioned on the shaft 108 and the threaded end 112 threaded into threaded aperture 128 provided through support 54. The roller unit 48 may be similarly installed, as by passing threaded end 120 of the shaft 114 through smooth aperture 130 provided through the support 60, positioning the roller members 100 and washers 102 onto the shaft 114 and threading the threaded end 120 into threaded aperture 132 provided through the support 58.

For the purpose of example only, the described member 40 having a thickness T of about 1 inch preferably has the following additional dimensions (FIGS. 5 and 6):

TABLE 1

| Dimension | Approx. Distance (in) |
|---|---|
| a | 1¼ i.d. |
| | 1½ o.d. |
| b | ¾ i.d. |
| | ⅞ o.d. |
| c | 1½ |
| d | 5/16 |
| e | 3⅛ |
| f | 1¼ |
| g | ¾ |
| h | 5/16 |
| i | 3 |
| j | 1¼ |
| k | 5/16 |
| l | 1/16 |
| m | 1¼ |

Returning now to FIG. 3, the device 10 is shown as preferably used to install carpet base 12 to the wall 18. The wall base 12 is preferably secured along the lower part of the wall 18 after a flooring such as wall-to-wall carpeting has been installed. The base may be applied from a roll thereof by pulling off a first short length of the base and removing the release liner to expose the adhesive or, if adhesive is applied directly to the base or the wall, such adhesive is applied along a similar length.

The base is then positioned at the desired location against the wall at a starting point such as at the corner between two walls with the lower edge at the wall-floor intersection and slight hand pressure is applied to initially press the base against the wall for contact of adhesive to both wall and base. The base is then unrolled to the end of the wall under hand tension to stretch the base slightly. Slight hand pressure is preferably applied to the outer surface of the base during this process to secure the base to the wall as the base is unrolled. Adjustments may then be made to the position of the base by hand to position the base evenly along the wall and firm pressure applied by use of the device 10 to finally fix the position of the base adjacent the wall. The lower edges of the base may be tucked under the edge of the carpeting by use of a tucking knife or stair tool and fasteners, such as staples may be used at the comers of the base or otherwise as desired for additional securement.

To accomplish the above securement of the base 12 to the wall using the device 10, the device is preferably positioned as shown in FIG. 3, with the roller unit 48 resting on the carpet 20 and the roller units 44 and 46 bearing against the base 12 such that the surfaces 50 and 52 of the body member 40 are generally perpendicular to the carpet and the length axis of the base 12 and are generally parallel to the height axis of the wall 18 and the width of the base 12. The handle 42 is held by the user and projects at the angle $\alpha$ away from the wall 18 such that pressure applied by the user to the device via the handle has components which bear the roller unit 48 against the carpet, the roller units 44 and 46 against the base 12 and the wall 18 and generally cause movement of the roller members in a direction away from the user which follows along the length of the base. In the view of FIG. 3, this will be understood to generate movement of the roller units in a direction toward the viewer of FIG. 3.

As will be noticed from FIG. 3, the lower end of the roller unit 46 is closely adjacent a portion of the roller unit 48. Thus, while the roller unit 46 only engages the wall base 12, it is maintained closely adjacent the floor or carpet 20. Likewise, the roller unit 48, only engages the carpet 20, but is maintained closely adjacent the wall base during use. This positioning of the roller units, wherein a portion of roller units which engage the different surfaces are closely adjacent, is advantageous to add stability to the device. This stability enables the device to be moved relatively rapidly during the installation process without adversely affecting the orientation of the roller units. Thus, the roller units remain substantially engaged with their respective surfaces, e.g., the wall base and the carpet, even when the device is moved relatively rapidly during the installation process.

Accordingly, the installation device of the invention advantageously facilitates installation of wall bases and enables improved installation of bases as compared to conventional installation devices. As will be appreciated, this not only improves the quality of the installation but also the speed of installation. For example, the device enables pressure to be applied to the base in a desired direction without the need for the user to stoop or otherwise bend down to the level of the base. Also, the configuration of the device enables more control over the direction and amount of pressure applied to the base and facilitates the application of pressure in a more uniform manner.

Figure 8:
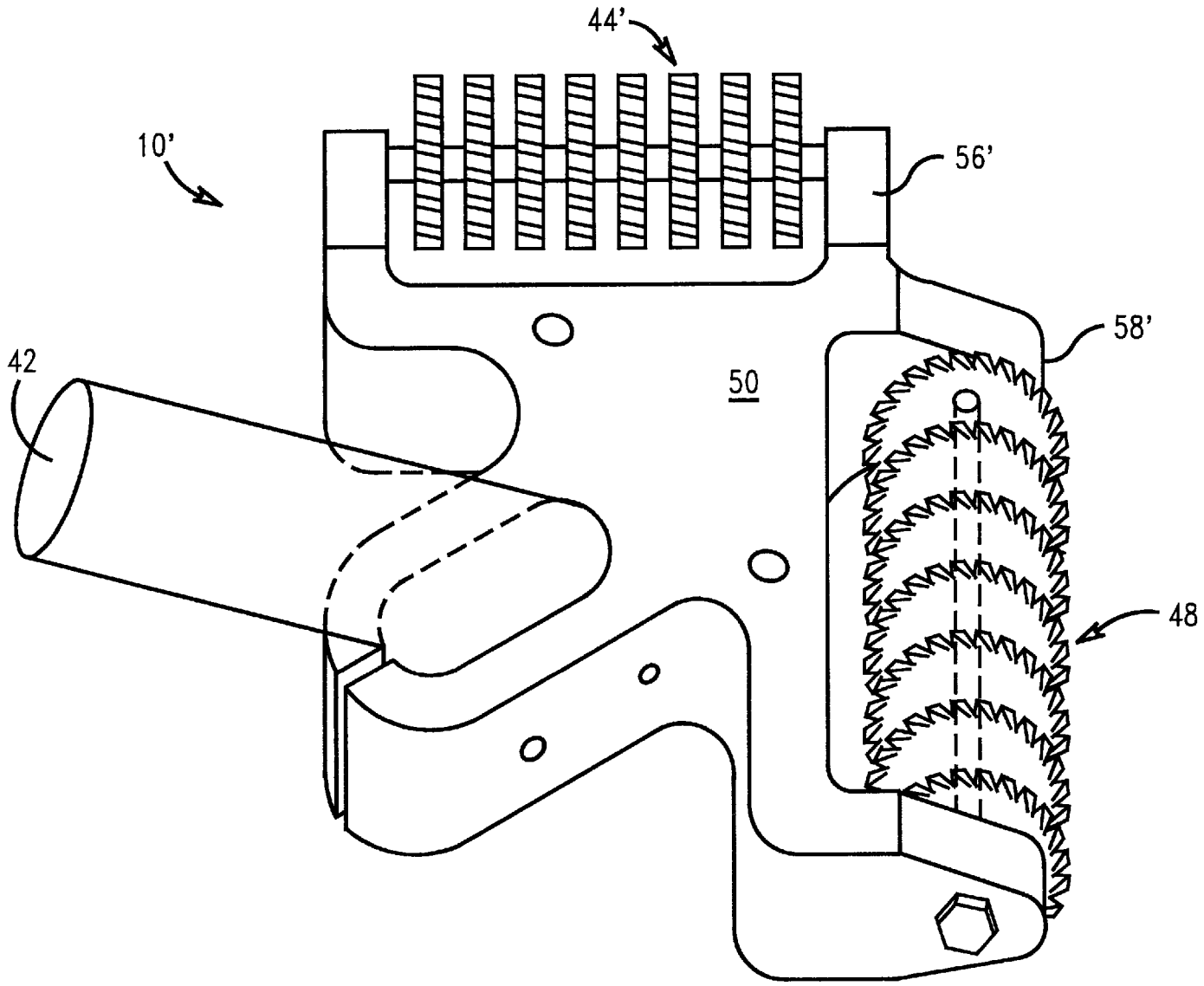
FIG. 8 is a perspective view of an alternate embodiment of the invention.

FIG. 8 is a perspective view of an alternate embodiment of an installation device 10'. The device 10' is identical to the device 10, except that the support 56 has been replaced by support 56' and roller units 44 and 46 have been combined into one roller unit 44'. As will be noticed, the support 56' is displaced so as to be flush with the end of a support 58' corresponding in location to the support 58. It is preferred, however, that the device be constructed according to the embodiment 10', as it has been observed that such construction more readily facilitates application of pressure to the lowermost portions of the base 12.

The foregoing description of certain exemplary embodiments of the present invention has been provided for purposes of illustration only, and it is understood that numerous modifications or alterations may be made in and to the illustrated embodiments without departing from the spirit and scope of the invention as defined in the following claims.

What is claimed is:

1. A device for installing an elongate wall base on a wall extending at an angle from a flooring surface, the device comprising:

a body member having a thickness and oppositely facing upper and lower surfaces spaced apart by the thickness of the body member, the body member including a first pair of spaced-apart supports extending outwardly from a first portion of the thickness of the body member to define a first recess bounded by mutually facing surfaces of the first pair of supports and the first portion of the thickness of the body member, and a second pair of spaced-apart supports extending outwardly from a second portion of the thickness of the body member to define a second recess bounded by mutually facing surfaces of the second pair of supports and the second portion of the thickness of the body member;

a handle extending upwardly from the upper surface of the body member and graspable by a user to apply pressure to the body member during use of the device to install the wall base;

a first roller unit positioned within the first recess and having a first axle extending between the first pair of supports, the first roller unit comprising a plurality of independently rotatable roller members positioned adjacent to one another and substantially aligned in a parallel spaced-apart relationship to one another along the first axle of the first roller unit, the roller members of the first roller unit each being rotatable around the first axle of the first roller unit; and a second roller unit positioned within the second recess and having a second axle extending between the second pair of supports, the second roller unit comprising a plurality of independently rotatable roller members positioned adjacent to one another and substantially aligned in a parallel spaced-apart relationship to one another along the second axle of the second roller unit, the roller members of the second roller unit each being rotatable around the second axle of the second roller unit, wherein the first roller unit is positionable to urge substantially all of the first roller members against a flooring surface and the second roller unit is positionable to urge substantially all of the second roller members against the wall base, while the device is moved in a direction generally along the length of the wall base to enable the user to apply pressure to the wall base to urge it against a wall to which the base is to be installed.

2. The device of claim 1, wherein the first axle of the first roller unit is mounted relative to the second axle such that a first angle defined by the intersection of the length axis corresponds to a second angle defined by the intersection of the flooring surface and the wall.

3. The device of claim 2, wherein the first and second angles are each about 90°.

4. The device of claim 1, wherein the first roller unit comprises an elongate shaft having a plurality of spaced-apart roller members rotatably mounted thereon, wherein the elongate shaft is fixedly secured to the first pair of supports.

5. The device of claim 1, wherein each roller member comprises a disk.

6. The device of claim 1, further comprising a third roller unit mounted to one of the supports of the first pair of supports.

7. The device of claim 6, wherein the third roller unit is substantially axially aligned with the first roller unit.

8. A device for installing wall base, such as carpet base, the device comprising a body member having a handle extending upwardly from the upper surface of the body member and graspable by a user to apply pressure to the body member during use of the device to install the wall base; and at least two roller units mounted to the body member, each roller unit comprising an elongate shaft having a plurality of spaced-apart roller members rotatably mounted thereon, wherein one roller unit is positionable to be urged against the flooring surface and the other roller unit is positionable to be urged against the wall base while the device is moved in a direction generally along the length of the wall base to enable the user to apply pressure to the wall base to urge it against the wall.

9. The device of claim 8, wherein each roller member comprises a disk.

* * * * *